US007520318B2

(12) United States Patent
Kwon

(10) Patent No.: US 7,520,318 B2
(45) Date of Patent: Apr. 21, 2009

(54) HEAT EXCHANGER FOR VEHICLE

(75) Inventor: Daebok Kwon, Daejeon-si (KR)

(73) Assignee: Halla Climate Control Corporation, Daejeon-Si (KR)

( * ) Notice: Subject to any disclaimer, the term of this patent is extended or adjusted under 35 U.S.C. 154(b) by 0 days.

(21) Appl. No.: 11/786,394

(22) Filed: Apr. 11, 2007

(65) Prior Publication Data

US 2007/0240861 A1 Oct. 18, 2007

(30) Foreign Application Priority Data

Apr. 13, 2006 (KR) ..... 10-2006-0033636

(51) Int. Cl.
*F28D 1/06* (2006.01)

(52) U.S. Cl. ..... 165/140; 165/80.4; 165/71; 361/699

(58) Field of Classification Search ..... 165/132, 165/140

See application file for complete search history.

(56) References Cited

U.S. PATENT DOCUMENTS 4,651,816 A 3/1987 Struss et al.
5,505,253 A * 4/1996 Heraud ..... 165/110
5,813,249 A * 9/1998 Matsuo et al. ..... 62/509
5,946,940 A * 9/1999 Inoue ..... 62/509
6,173,766 B1 1/2001 Nakamura et al.
6,334,333 B1 * 1/2002 Shinhama ..... 62/509
6,698,236 B2 * 3/2004 Yamasaki et al. ..... 62/509
7,284,594 B2 * 10/2007 Sanada et al. ..... 165/41
2001/0035284 A1 * 11/2001 Iwasaki et al. ..... 165/135
2003/0051503 A1 * 3/2003 Nobuta et al. ..... 62/509
2004/0094288 A1 * 5/2004 Hoyle ..... 165/41
2004/0206483 A1 * 10/2004 Shinhama ..... 165/140
2005/0098306 A1 * 5/2005 Ghiani ..... 165/140
2005/0217831 A1 * 10/2005 Manaka ..... 165/140
2005/0217832 A1 * 10/2005 Sanada et al. ..... 165/140

FOREIGN PATENT DOCUMENTS

JP 57-76120 5/1982
JP 2001-059420 3/2001

* cited by examiner

*Primary Examiner*—Allen J Flanigan
(74) *Attorney, Agent, or Firm*—Fulbright & Jaworski L.L.P.

(57) ABSTRACT

The present invention relates to a heat exchanger for a vehicle, in which a second radiator as a heat exchanger for cooling electronic components, such as an inverter and a motor, and a first radiator as a heat exchanger for cooling an engine are manufactured into an integral-type heat exchanger, and a reservoir tank is integrally coupled to the integral-type heat exchanger.

9 Claims, 6 Drawing Sheets

Prior Art

HEAT EXCHANGER FOR VEHICLE

This application claims priority from Korean Patent Application No. 10-2006-0033636 filed Apr. 13, 2006, incorporated herein by reference in its entirety.

BACKGROUND OF THE INVENTION

1. Field of the Invention

The present invention relates to a heat exchanger for a hybrid electric vehicle, and more particularly, to a heat exchanger for a vehicle, in which a second radiator as a heat exchanger for cooling electronic components, such as an inverter and a motor, and a first radiator as a heat exchanger for cooling an engine are manufactured into an integral-type heat exchanger, and a reservoir tank is integrally coupled to the integral-type heat exchanger.

2. Background Art

In general, there are well-known vehicles which use an engine as a driving power source as well as hybrid vehicles which use an electric power source including a motor.

Such a hybrid vehicle is configured of a type in which an electric motor is coupled to a combustion engine, such as a gasoline engine or a diesel engine, and has been commercialized and put on the market abroad. The hybrid vehicle has a merit in that it can provide a high fuel consumption ratio and minimize the discharge of exhaust gas during the traveling in the downtown where the vehicle travels at a relatively low speed while repeating the stop and start operations, and hence it has been developed in various types also in Korea.

As described above, most of the hybrid vehicles, which are now being put on the market or developed, are mainly configured in a type in which the combustion engine and the motor are coupled with each other. Similarly to general vehicles, the hybrid vehicle must be equipped with an engine cooling system for keeping a proper temperature of the gasoline engine or the diesel engine as well as a separate cooling system for cooling a large amount of heat generated from the electronic components, such as an inverter for converting a DC current of a battery into an AC current for driving the motor.

Japanese Patent Laid-Open Publication No. 2001-59420 discloses a heat exchanger having an engine cooling system and an electronic component cooling system. The heat exchanger will be described hereinafter with reference to FIG. 1.

As shown in FIG. 1, the heat exchanger includes: an engine 1; a first water pump 6 receiving driving power from the engine 1 for circulating cooling water between the engine 1 and a first radiator 2; a second water pump 5 for circulating cooling water between an electronic component 11, such as an inverter, and a second radiator 3; a first reservoir tank 7 for storing cooling water when cooling water contained in the first radiator 2 overflows; a second reservoir tank 8 for storing cooling water when cooling water contained in the second radiator 2 overflows; a first injection port 9 for injecting or replenishing cooling water to the first radiator 2; and a second injection port 10 for injecting or replenishing cooling water to the second radiator 3.

The first radiator 2 and the second radiator 3 are formed integrally with each other in such a manner as to be stacked on top of each other.

However, the heat exchanger according to the prior art has the following problems.

First, since the first and second reservoir tanks 7 and 8 and the first and second radiators 2 and 3 are configured of separate components, an assembly process is complicated in which hoses or tubes is connected thereto for fluidically communicating the first and second reservoir tanks 7 and 8 with the first and second radiators 2 and 3, respectively, to allow cooling water to flow therebetween through the hose or tubes. In addition, since the first and second reservoir tanks 7 and 8 are mounted separately, there is a restriction in space in installing them at a small area inside the vehicle.

Second, since the first and second reservoir tanks 7 and 8 and the first and second radiators 2 and 3 are configured of separate components, manufacturing facilities for manufacturing them must be made independently due to their different manufacturing methods.

SUMMARY OF THE INVENTION

Accordingly, the present invention has been made to solve the above-mentioned problems occurring in the prior arts, and it is an object of the present invention to provide a heat exchanger for a vehicle, in which a second radiator as a heat exchanger for cooling electronic components such as an inverter and a motor, and a first radiator as a heat exchanger for cooling an engine are manufactured into an integral-type heat exchanger, and a reservoir tank is integrally coupled to the integral-type heat exchanger.

To accomplish the above object, according to the present invention, there is provided a heat exchanger for a vehicle including: a first radiator for heat-exchanging high-temperature cooling water passing through an engine, into low-temperature cooling water and discharging the low-temperature cooling water toward the engine; a second radiator mounted integrally with the first radiator, the second radiator allowing high-temperature cooling water passing through an electronic component equipped inside the vehicle to pass therethrough, heat-exchanging the high-temperature cooling water into low-temperature cooling water, and discharging the low-temperature cooling water to the electronic component; and a reservoir tank bonded integrally to the second radiator via a communication pipe by means of brazing for allowing cooling water to be introduced from the second radiator to the reservoir tank through the communication pipe, the reservoir tank having a cooling water outlet located higher than the upper portion of the second radiator for allowing the introduced cooling water to flow toward the electronic component.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Reference will be now made in detail to the preferred embodiment of the present invention with reference to the attached drawings.

Figure 1:
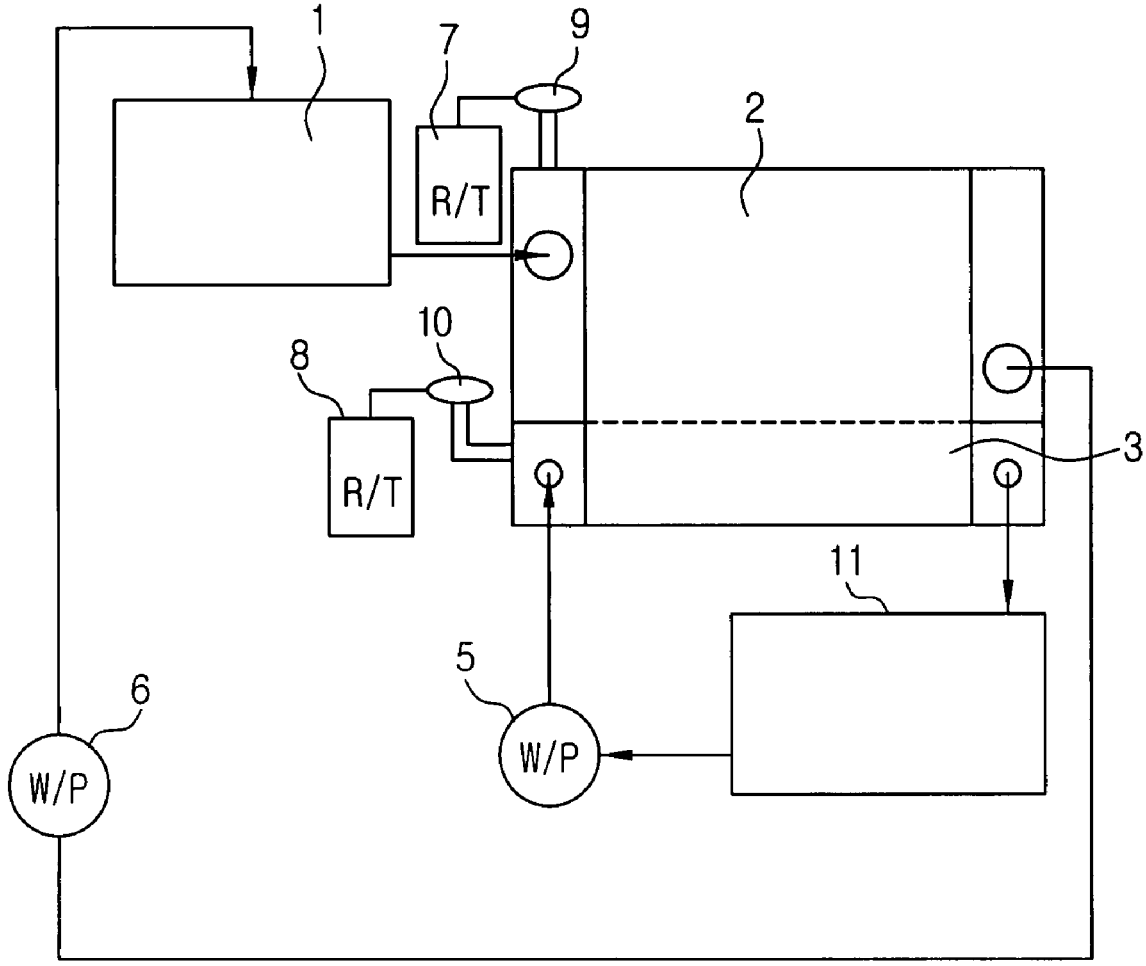
FIG. 1 is a brief view of a configuration of a cooling system of a hybrid electric vehicle according to a prior art.
Figure 2:
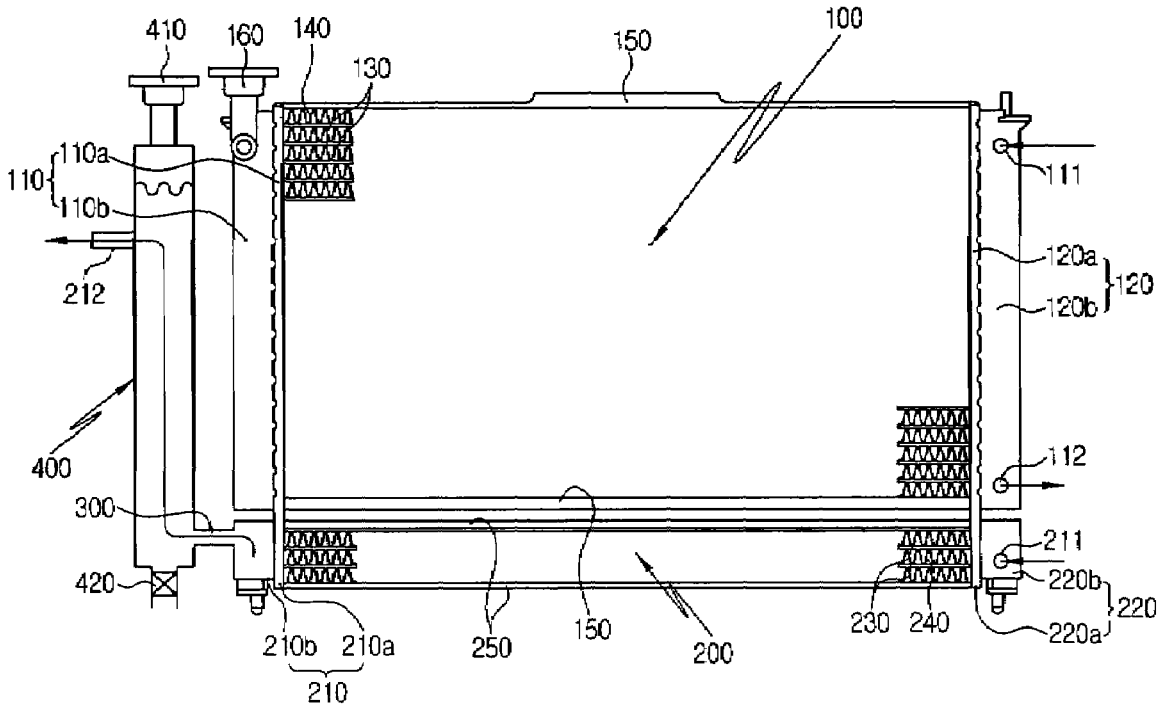
FIG. 2 is a front view of a heat exchanger for a vehicle according to a preferred embodiment of the present invention.
Figure 3:
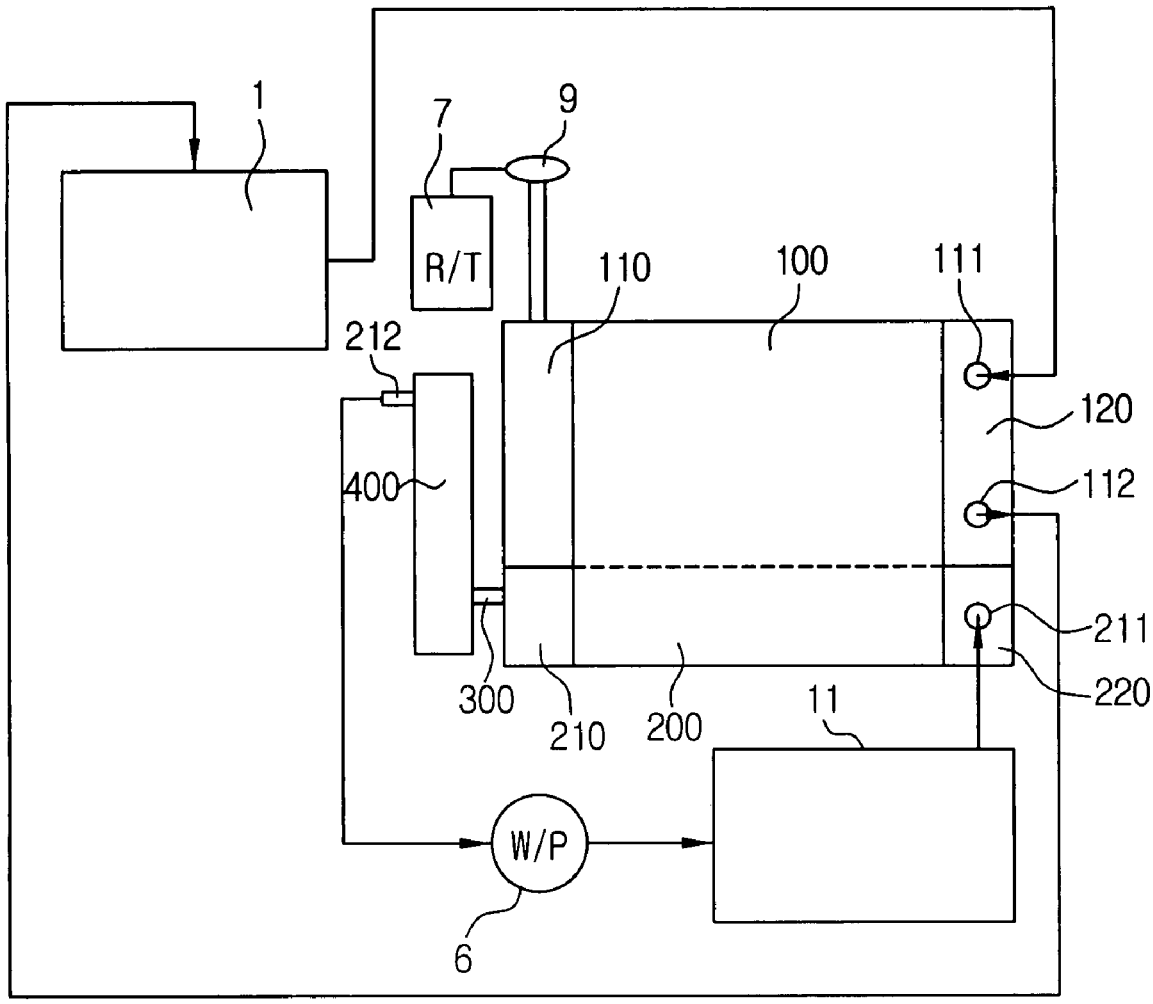
FIG. 3 is a view showing a configuration of a cooling system of a hybrid electric vehicle according to the present invention.
Figure 4:
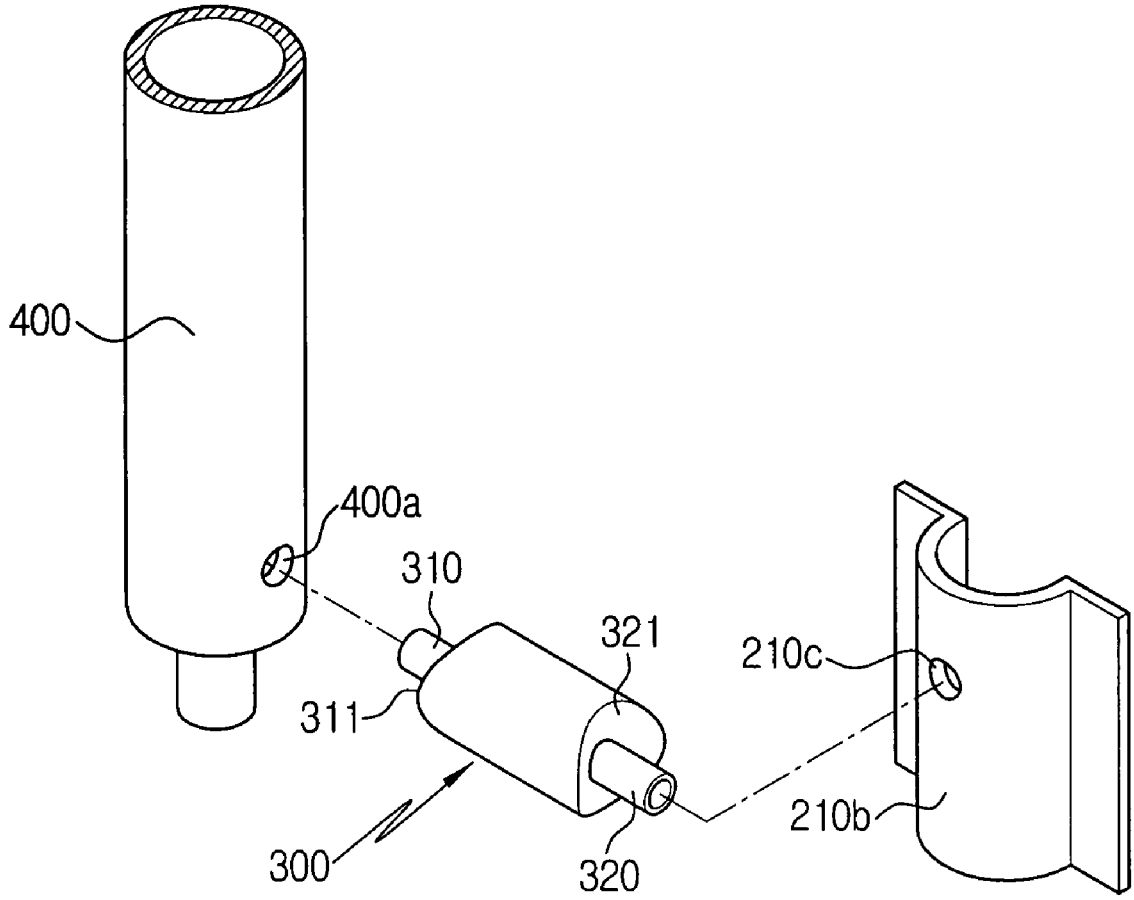
FIG. 4 is an exploded perspective view showing a combined relation among a reservoir tank, a communication pipe and a tank of a second radiator according to the present invention.
Figure 5:
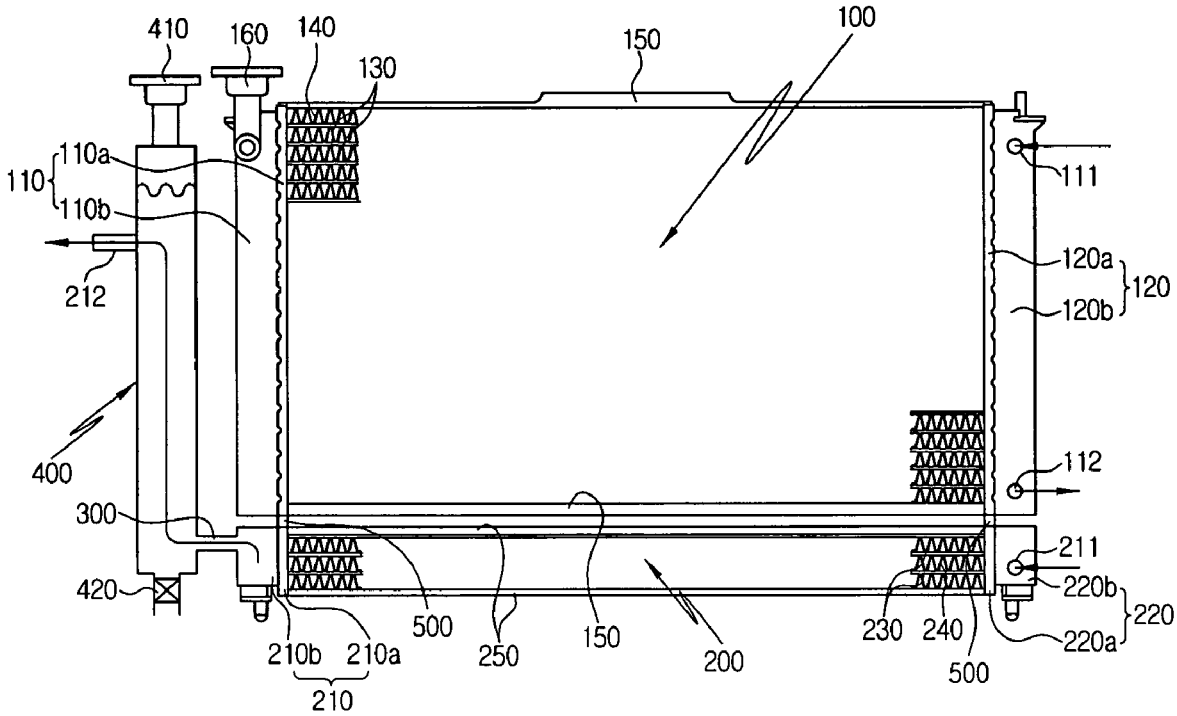
FIG. 5 is a front view of a heat exchanger according to another preferred embodiment of the present invention.
Figure 6:
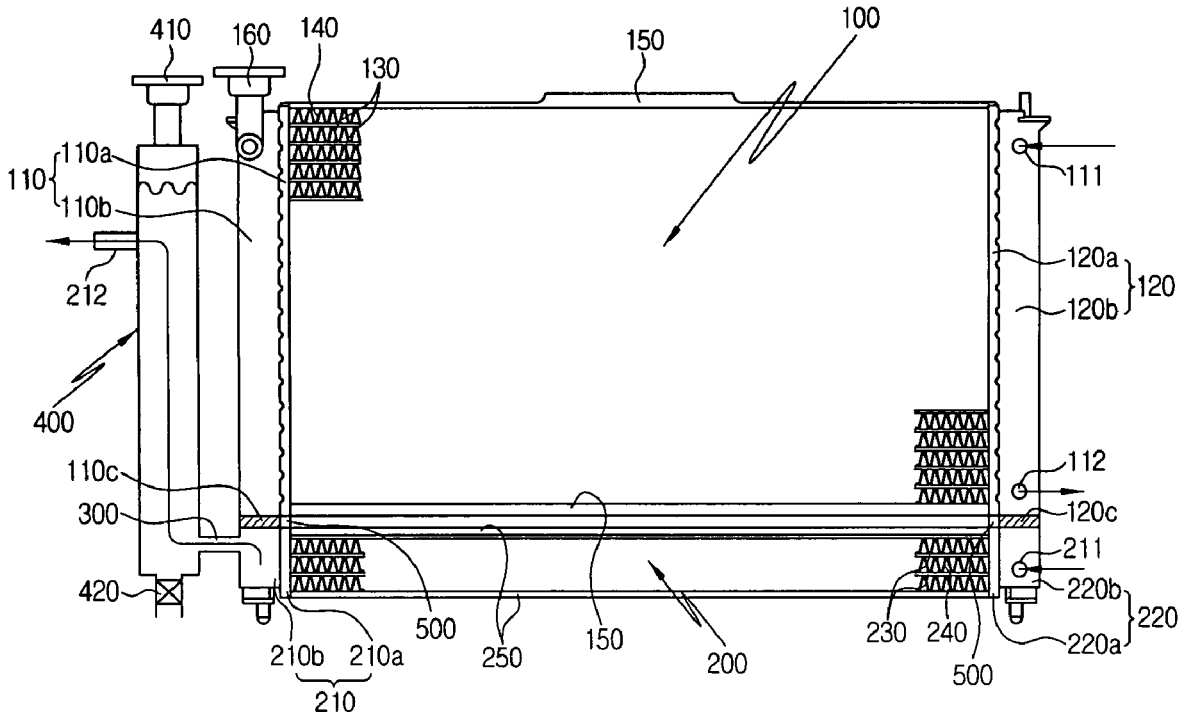
FIG. 6 is a front view of a heat exchanger according to a further preferred embodiment of the present invention.

FIG. 2 is a front view of a heat exchanger for a vehicle according to a preferred embodiment of the present invention, FIG. 3 is a view showing a configuration of a cooling system of a hybrid electric vehicle according to the present invention, FIG. 4 is an exploded perspective view showing a combined relation among a reservoir tank, a communication pipe and a tank of a second radiator according to the present invention, FIG. 5 is a front view of a heat exchanger according to another preferred embodiment of the present invention, and FIG. 6 is a front view of a heat exchanger according to a further preferred embodiment of the present invention.

As shown in the drawings, the heat exchanger according to the present invention includes a first radiator 100, a second radiator 200, and a reservoir tank 400.

The first radiator 100 receives high-temperature cooling water passing through an engine, heat-exchanges the high-temperature cooling water into low-temperature cooling water, and then, discharges the low-temperature cooling water toward the engine.

The first radiator 100 includes: a pair of header tanks 110 and 120 spaced apart from each other; a plurality of tubes 130 whose ends are coupled between the header tanks 110 and 120 in such a manner as to fluidically communicate with one another to allow cooling water to flow therethrough; radiation fins 140 mounted between the tubes 130; and first supports 150 mounted on the upper portion and the lower portion thereof. The header tanks 110 and 120 have a cooling water inlet 111 and a cooling water outlet 112.

The header tanks 110 and 120 are vertically arranged at the right and left of the first radiator 100 and formed by combining headers 110*a* and 120*a* and tanks 110*b* and 120*b* to each other. In the drawings, as an example, the cooling water inlet 111 and the cooling water outlet 112 are formed on a tank 120*b* of the header tank 120 located at the right side.

However, it would be appreciated that the cooling water inlet 111 and the cooling water outlet 112 may be respectively formed on both of the header tanks 110 and 120.

The first supports 150 are mounted on the first radiator 100 to fix the radiation fins 140 arranged on the outer surface of one side tube 130 or the other side tube 130 located at the outermost side of the first radiator 100.

Here, one side tube 130 means the tube arranged at the uppermost portion of the radiator 100 in FIG. 2, and the other side tube 130 means the tube arranged at the lowermost portion of the radiator 100.

Moreover, not shown in the drawings, but in case where the header tanks of the first radiator 100 are arranged not vertically but laterally, one side tube 130 means the tube arranged at the leftmost portion of the radiator 100, and the other side tube 130 means the tube arranged at the rightmost portion of the radiator 100.

That is, both ends of the first support 150 mounted on the upper part of the first radiator 100 are coupled with the upper end portions of the headers 110*a* and 120*a*, and the remaining portions of the first support 150 are bonded to the outer surface of the radiation fin 140 located at the uppermost portion of the first radiator 100 by means of brazing.

In addition, both ends of the first support 150 mounted on the lower part of the first radiator 100 are coupled with the lower end portions of the headers 110*a* and 120*a*, and the remaining portions of the first support 150 are bonded to the outer surface of the radiation fin 140 located at the uppermost portion of the first radiator 100 by means of brazing.

As described above, since the first supports 150 are respectively mounted on the upper part and the lower part of the first radiator 100, the radiation fins 140 and the tubes 130 are protected from the outside and strength of the first radiator 100 is generally reinforced.

Furthermore, since the both ends of the first supports 150 are coupled with the upper and lower ends of the headers 110*a* and 120*a* during a temporary assembly of the first radiator 100, the radiation fins 140 and the tubes 130 are not distorted or transformed in their positions.

Here, in the drawing, the unexplained reference numeral 160 indicates a filler neck serving to inject cooling water into the first radiator and eliminate air contained in the first radiator.

Meanwhile, the second radiator 200 is arranged on at least one of upper and lower sides and right and left sides of the first radiator 100 and bonded integrally to the first radiator 100 by means of brazing. The second radiator 200 receives the high-temperature cooling water passing through an electronic component equipped inside the vehicle, heat-exchanges the low-temperature cooling water into the low-temperature cooling water, and then, discharges cooling water to the electronic component 11.

Hereinafter, a detailed configuration of the second radiator 200 will be described.

The second radiator 200 includes: a pair of header tanks 210 and 220 spaced apart from each other; a plurality of tubes 230 whose ends are coupled between the header tanks 210 and 220 in such a manner as to fluidically communicate with one another to allow cooling water to flow therethrough; radiation fins 240 mounted between the tubes 230; and second supports 250 mounted on the upper portion and the lower portion thereof. The header tanks 210 and 220 have a cooling water inlet 211 and a cooling water outlet 212.

The header tanks 210 and 220 are vertically arranged at the right and left sides of the second radiator 200 and formed by combining headers 210*a* and 220*a* and tanks 210*b* and 220*b* to each other.

In the drawings, as an example, cooling water inlet 211 is formed on a tank 220*b* of the header tank 220 and cooling water outlet 212 is formed on the reservoir tank 400.

The second supports 250 are mounted on the second radiator 200 to fix the radiation fins 240 arranged on the outer surface of one side tube 230 or the other side tube 230 located at the outermost side of the second radiator 200.

Here, one side tube 230 means the tube arranged at the uppermost portion of the radiator 200 in FIG. 2, and the other side tube 230 means the tube arranged at the lowermost portion of the radiator 200.

Moreover, not shown in the drawings, but in case where the header tanks of the radiator 200 are arranged not vertically but laterally, one side tube 130 means the tube arranged at the leftmost portion of the radiator 200, and the other side tube 230 means the tube arranged at the rightmost portion.

That is, both ends of the second support 250 mounted on the upper part of the second radiator 200 are coupled with the upper end portions of the headers 210*a* and 220*a*, and the remaining portions of the second support 250 are bonded to the outer surface of the radiation fin 240 located at the uppermost portion of the second radiator 200 by means of brazing.

In addition, both ends of the second support 250 mounted on the lower part of the second radiator 200 are coupled with the lower end portions of the headers 210*a* and 220*a*, and the remaining portions of the second support 250 are bonded to the outer surface of the radiation fin 240 located at the uppermost portion of the second radiator 200 by means of brazing.

As described above, since the second supports 250 are respectively mounted on the upper part and the lower part of the second radiator 200, the radiation fins 240 and the tubes 230 are protected from the outside and strength of the second radiator 200 is generally reinforced.

Furthermore, since the both ends of the second supports 250 are coupled with the upper and lower ends of the headers 210*a* and 220*a* during a temporary assembly of the second radiator 200, the radiation fins 240 and the tubes 230 are not distorted or transformed in their positions.

A communication pipe 300 is connected to the reservoir tank 400 to introduce cooling water passing through the second radiator 200 to the reservoir tank 400, and the reservoir tank 400 has a cooling water outlet 212 mounted at a position higher than the upper portion of the second radiator 200 for allowing a flow of cooling water toward the electronic component 11.

That is, the reservoir tank 400 is mounted integrally with the second radiator 200 through the communication pipe 300, and includes a filler neck 410 formed on the upper portion thereof for replenishing cooling water and a drain part 420 formed on the lower portion thereof for discharging cooling water if necessary.

In the present invention, as an example, the communication pipe 300 is formed on the tank 210*b* of the header tank 210 of the second radiator 200.

The reservoir tank 400 is fixed to the second radiator 200 by means of brazing. More concretely, the reservoir tank 400 is coupled to the second radiator 200 in such a way that one end of the communication pipe 300 is fluidically communicated with a through-hole 400*a* formed on the reservoir tank 400 and the other end is fluidically communicated with a through-hole 210*c* formed on the tank 210*b* of the header tank 210 of the second radiator 200, temporarily assembled with the second radiator 200, and then, formed integrally with the second radiator 200 by means of brazing.

That is, the communication pipe 300 includes insertion portions 310 and 320 formed at both ends thereof and inserted to the through-hole 400*a* and the through-hole 210*c*, and matched portions 311 and 321 formed on the outer surfaces of the insertion portions 310 and 320 and bonded to the outer surface of the reservoir tank 400 and the outer surface of the tank 210 to be in a surface contact state.

As described above, since the first radiator 100, the second radiator 200, the communication pipe 300 and the reservoir tank 400 of the heat exchanger are formed integrally with one another by brazing-welding the in a brazing furnace after the temporary assembly, the present invention can simplify a manufacturing process to improve an assembly efficiency, be manufactured in a packaged state, and mass-produced.

That is, as shown in FIG. 2, in this embodiment where the second radiator 200 is arranged below the first radiator 100 and coupled integrally with the first radiator 100 by means of brazing, the headers 110*a* and 120*a* of the first radiator 100 and the headers 210*a* and 220*a* of the second radiator 200 can be formed integrally with each other.

In more detail, one side header 110*a* of the first radiator 100 and one side header 210*a* of the second radiator 200 located on an extension line longitudinally extended from the header 110*a* are formed integrally with each other into an a single header, and the other side header 120*a* of the first radiator 100 and the other side header 220*a* of the second radiator 200 located on an extension line longitudinally extended from the header 120*a* are also formed in the integral-type. So, the one side integral-type headers 110*a* and 210*a* and the other side integral-type headers 120*a* and 220*a* can be used in common.

Here, the configurative structure of the one side integral-type headers 110*a* and 210*a* and the other side integral-type headers 120*a* and 220*a* is varied according to an arranged relation of the first radiator 100 and the second radiator 200.

That is, in case where the second radiator 200 is arranged near to the upper or lower side of the first radiator 100, the one side integral-type headers 110*a* and 210*a* and the other side integral-type headers 120*a* and 220*a* are in a straight form.

However, in case where the second radiator 200 is arranged on the right or left side of the first radiator 100, the one side integral-type headers 110*a* and 210*a* and the other side integral-type headers 120*a* and 220*a* may be in an approximately "∩" shape of different sizes.

A method for temporarily assembling the components of the present invention using the one side integral-type headers 110*a* and 210*a* and the other side integral-type headers 120*a* and 220*a*, which are used in common, will be described as follows.

The one side integral-type headers 110*a* and 210*a* and the other side integral-type headers 120*a* and 220*a* are arranged on the right and left sides of the heat exchanger to be faced to each other, and then, a plurality of the tubes 130 are arranged between the one side integral-type headers 110*a* and 210*a* and the other side integral-type headers 120*a* and 220*a* at intervals approximately corresponding to a vertical height of the radiation fins 140. In this instance, one end of each tube 130 is inserted and coupled to an insertion hole (not shown) formed on one side header 110*a* of the first radiator 100, and the other end of each tube 130 is inserted and coupled to an insertion hole (not shown) formed on the other side header 120*a* of the first radiator 100.

Next, the radiation fins 140 are inserted and mounted between the tubes 130 and arranged on the outer surfaces of the tubes 130 located at the uppermost and lowermost arrays.

After that, the radiation fins 140 respectively arranged on the outer surfaces of the tubes 130 located at the uppermost and lowermost arrays are fixed, and then, the first support 150 is coupled to the radiation fins 140 to protect the headers and tubes from the outside. One end portion of the first support 150 is inserted and coupled to an insertion hole (not shown) formed on one side header 110*a* of the first radiator 100, and the other end portion of the first support 150 is inserted and coupled to an insertion hole (not shown) formed on the other side header 120*a* of the first radiator 100.

When the first support 150 is mounted as described above, the radiation fins 140 respectively arranged on the outer surfaces of the tubes 130 located at the uppermost and lowermost arrays are in contact with the first support 150.

Here, the two first supports 150, as described above, are mounted on the upper and lower sides of the first radiator 100, but the number and position of the first supports 150 are not restricted to the above. The first support 150 can fix at least one of the radiation fins 140 arranged on the outer surfaces of the tubes 130 located at the uppermost and lowermost arrays, and so, one first support 150 may be mounted on the upper or lower part of the first radiator 100.

Finally, the tank 110*b*, on which the filler neck 160 is mounted, is coupled to one side header 110*a* of the first radiator 100, and the tank 120*b* which has the cooling water inlet 111 and the cooling water outlet 112 is coupled to the other side header 120*a* of the first radiator 100, and thereby, the first radiator 100 is assembled temporarily.

In this instance, an operator assembles the second radiator 200 temporarily while assembling the first radiator 100 temporarily.

That is, the tubes 230 are arranged between the one side integral-type headers 110*a* and 210*a* and the other side integral-type headers 120*a* and 220*a* at intervals approximately corresponding to the vertical height of the radiation fins 240. In this instance, one end of each tube 230 is inserted and coupled to an insertion hole (not shown) formed on one side header 210*a* of the second radiator 200, and the other end of each tube 230 is inserted and coupled to an insertion hole (not shown) formed on the other side header 220*a* of the second radiator 200.

Next, the radiation fins 240 are inserted and mounted between the tubes 230, and arranged on the outer surfaces of the tubes 230 located at the uppermost and lowermost arrays.

After that, the radiation fins 240, which are respectively arranged on the outer surfaces of the tubes 230 located at the uppermost and lowermost arrays, are fixed, and then, the second support 250 is coupled to the radiation fins 240 to protect the headers and tubes from the outside. One end portion of the second support 250 is inserted and coupled to an insertion hole (not shown) formed on one side header 210*a* of the second radiator 200, and the other end portion of the second support 250 is inserted and coupled to an insertion hole (not shown) formed on the other side header 220*a* of the second radiator 200.

When the second support 250 is mounted as described above, the radiation fins 240 respectively arranged on the outer surfaces of the tubes 230 located at the uppermost and lowermost arrays are in contact with the second support 250.

Here, the two second supports 250, as described above, are mounted on the upper and lower sides of the second radiator 200, but the number and position of the second supports 250 are not restricted to the above. The second support 250 can fix at least one of the radiation fins 240 arranged on the outer surfaces of the tubes 230 located at the uppermost and lowermost arrays, and so, one second support 250 may be mounted on the upper or lower part of the second radiator 200.

Finally, the tank 210*b* is coupled to one side header 210*a* of the second radiator 200, and the tank 220*b* which has the cooling water inlet 211 is coupled to the other side header 220*a* of the second radiator 200, and thereby, the second radiator 100 is assembled temporarily.

After the first and second radiators 100 and 200 are assembled temporarily as described above, in a state where the reservoir tank 400 having the cooling water outlet 212 is temporarily assembled with the second radiator 200 via the communication pipe 300, they are put into the brazing furnace so that the first and second radiators 100 and 200, the reservoir tank 400 and the communication pipe 300 are formed integrally with one another while clad material is melted at their bonded portions. Here, the clad material is previously coated on the above components before the components are assembled temporarily.

Differently from the above description, the first and second radiators 100 and 200 and the reservoir tank 400 are not brazed integrally with each other, but as shown in FIG. 5, the headers 110*a* and 120*a* of the first radiator 100 and the headers 210*a* and 220*a* of the second radiator 200 may be formed separately. In more detail, in case where one side header 110*a* of the first radiator 100 and one side header 210*a* of the second radiator 200 are formed as separated parts and the other side header 120*a* of the first radiator 100 and the other side header 220*a* of the second radiator are formed as separated parts, the second radiator 200 is temporarily assembled with the header tanks 210 and 220, the tubes 230, the radiation fins 240, the second supports 250, the cooling water inlet 211 and the cooling water outlet 212 which are all coated with the clad material. After that, in a state where the reservoir tank 400 and the communication pipe 300 are temporarily assembled with the second radiator 200, they are put into the brazing furnace so that the second radiator 200 and the reservoir tank 400 are formed integrally with each other while the clad material is melted at their bonded portions, and thereby, only the second radiator 200 and the reservoir tank 400 are formed integrally with each other.

Here, as shown in FIG. 2, since the first radiator 100 and the second radiator 200 do not use the headers in common, the headers 110*a* and 120*a* of the first radiator 100 and the headers 210*a* and 220*a* of the second radiator 200 are connected with each other via a connecting means 500. The connecting means 500 may be a plate of a predetermined length made of an aluminum material. The connection means 500 is also brazing-bonded to the first radiator 100 and the second radiator 200 in the brazing furnace.

Meanwhile, in case where the header 110*a* of the first radiator 100 and the header 210*a* of the second radiator 200 are formed as separated parts and the header 120*a* of the first radiator 100 and the header 220*a* of the second radiator are formed as separated parts, as shown in FIG. 6, it is natural that the tank 110*b* of the first radiator 100 and the tank 210*b* of the second radiator 200 are formed integrally with each other into an a single header and the tank 120*b* of the first radiator 100 and the tank 220*b* of the second radiator 200 are formed in the integral-type.

Therefore, only core parts consisting of the radiation fins and the tubes of the first radiator 100 and the second radiator 200 are coupled with each other in a separate system, and the commonly used tanks 110*b* and 210*b*, in which the tank 110*b* of the first radiator 100 and the tank 210*b* of the second radiator 200 are formed in the integral-type, and the commonly used tanks 120*b* and 220*b*, in which the tank 120*b* of the first radiator 100 and the tank 220*b* of the second radiator 200 are in the integral-type, are coupled to the radiation fins and the tubes, so that the present invention improves productivity.

Here, baffles 110*c* and 120*c* are respectively formed in the left side integral-type tanks 110*b* and 210*b* and in the right side integral-type tanks 120*b* and 220*b* for partitioning a space of the left side integral-type tanks 110*b* and 210*b* and a space of the right side integral-type tanks 120*b* and 220*b* to prevent mixing of cooling water of the first radiator 100 and cooling water of the second radiator 200.

Due to the baffles 110*c* and 120*c*, cooling water introduced into the cooling water inlet 111 passes only an area of the first radiator 100 including the right and left header tanks 110 and 120 of the first radiator 100, and then, is discharged to the cooling water outlet 112.

In addition, cooling water introduced into the cooling water inlet 211 passes only an area of the second radiator 200 including the right and left header tanks 210 and 220 of the second radiator 200, and then, is discharged to the cooling water outlet 212.

So, since the second radiator 200 and the reservoir tank 400 are brazing-bonded with each other via the communication pipe 300 into the integral-type form and the first radiator 100 is also formed integrally with the second radiator 200, the present invention simplifies the assembly process and improves productivity by means of brazing-bonding the components in the brazing furnace after the temporary assembly of the components. That is, differently form the prior art, the present invention does not need an assembly process to connect a separate hose or tube for communicating cooling water to the heat exchanger.

Furthermore, since the reservoir tank is mounted integrally with the first radiator and the second radiator, even though the inner space of the vehicle is small, the reservoir tank can be mounted sufficiently if a space for installing the first and second radiators is secured.

Additionally, since the first radiator, the second radiator and the reservoir tank are formed integrally with one another into a one piece, they can be easily mounted inside the vehicle and detached from the vehicle.

Meanwhile, it is preferable that the first radiator 100, the second radiator 200, the reservoir tank 400 and the communication pipe 300 are made of aluminum material.

A flow process of cooling water in the heat exchanger according to the present invention will be described as follows.

First, when the engine of the vehicle is started, a first water pump (not shown) is operated by driving power of the engine, and cooling water reaches a high-temperature state while passing through the engine. After that, cooling water is introduced into the first radiator 100 through the cooling water inlet 111, and heat-exchanges with the outside air while passing through the first radiator 100. The heat-exchanged cooling water is discharged from the cooling water outlet 112 in a low-temperature state, and then, returned toward the engine to cool the engine.

That is, the above process is repeated by pumping force of the first water pump.

Meanwhile, cooling water heated while passing through the electronic component 11 is introduced into the cooling water inlet 212 of the second radiator 200 by pumping force of another water pump (W/P) 6. The introduced cooling water passes through the second radiator 200, is stored in the reservoir tank 400 through the communication pipe 300, and then, discharged through the cooling water outlet 212 in the low-temperature state. The discharged cooling water is returned toward the electronic component 11 to cool the electronic component 11.

That is, since the cooling water outlet 212 is located higher than the second radiator 200, in spite of a volume change of cooling water, the reservoir tank 400 can keep cooling water of a proper amount.

Compared with the prior art in which the same cooling water is continuously circulated by a process that cooling water discharged from the second radiator 3 cools the electronic component 11 and returned to the second radiator 3, the present invention can lower an average temperature of cooling water of the second radiator 200 by circulating cooling water in a flow process of "second radiator 200→reservoir tank 400→electronic component 11→second radiator 200".

The heat exchanger according to the prior art in which cooling water is circulated in a flow process of "second radiator 3→electronic component 11→second radiator 3" may cause deposition of impurities and corrosion since cooling water is gathered in the second reservoir tank 8. However, since the heat exchanger according to the present invention has the structure that cooling water is circulated in the flow process of "second radiator 200→reservoir tank 400→electronic component 11→second radiator 200", the present invention can prevent deposition of impurities and corrosion by minimizing an one-side gathering of cooling water in the entire components including the second radiator 200.

In the heat exchanger described above, cooling water is introduced to the first radiator 100 after passing through the engine.

In the present invention, the electronic component means a control unit for an electronic control in a vehicle driven only by a combustion engine or an inverter installed to drive the motor in a hybrid vehicle having an electric power source by a motor.

In addition, the electronic component also means a generator and a driving motor for generating electricity in the combustion engine.

As described above, the heat exchanger according to the present invention can simplify the assembly process and improve productivity since the second radiator which is the heat exchanger for cooling the electronic components, such as the inverter and the motor, and the first radiator which is the heat exchanger for cooling the engine are manufactured into an integral-type heat exchanger and the reservoir tank is integrally coupled to the integral-type heat exchanger.

While the present invention has been described with reference to the particular illustrative embodiment, it is not to be restricted by the embodiment but only by the appended claims. It is to be appreciated that those skilled in the art can change or modify the embodiment without departing from the scope and spirit of the present invention.

What is claimed is:

1. A heat exchanger for a vehicle comprising:

a first radiator for heat-exchanging high-temperature cooling water passing though an engine, into low-temperature cooling water and discharging the low-temperature cooling water toward the engine;

a second radiator mounted integrally with the first radiator, the second radiator allowing high-temperature cooling water passing though an electronic component equipped inside the vehicle to pass therethrough, heat-exchanging the high-temperature cooling water into low-temperature cooling water, and discharging the low-temperature cooling water to the electronic component; and a reservoir tank bonded integrally to the second radiator via a communication pipe by means of brazing for allowing cooling water to be introduced from the second radiator to the reservoir tank though the communication pipe, the reservoir tank having a cooling water outlet located higher than an upper portion of the second radiator for allowing the introduced cooling water to flow toward the electronic component, a filler neck formed on the upper portion thereof for replenishing cooling water, and a drain part formed on the lower portion thereof for discharging cooling water.

2. The heat exchanger according to claim 1, wherein each of the first and second radiators includes:

a pair of header tanks spaced apart from each other and formed by combining headers and tanks with each other;

a plurality of tubes whose ends are coupled between the header tanks in such a manner as to fluidically communicate with one another to allow cooling water to flow therethrough; and radiation fins mounted between the tubes, wherein one side header of the first radiator and one side header of the second radiator are formed integrally with each other into an a single header, and the other side header of the first radiator and the other side header of the second radiator are formed integrally with each other into an a single header, wherein the header tanks of the first radiator have a cooling water inlet and a cooling water outlet, and wherein one of the header tanks of the second radiator has a cooling water inlet.

3. The heat exchanger according to claim 2, further comprising:

a first support mounted on the first radiator to fix the radiation fins arranged on the outer surface of at least one of one side tube and the other side tube located at the outermost side of the first radiator; and a second support mounted on the second radiator to fix the radiation fins arranged on the outer surface of at least one of one side tube and the other side tube located at the outermost side of the second radiator.

4. The heat exchanger according to claim 2, wherein after the first radiator is temporarily assembled with the header tanks, the tubes, the radiation fins, the cooling water inlet and the cooling water outlet for the first radiator and the second radiator is temporarily assembled with the header tanks, the tubes, the cooling water inlet and the cooling water outlet for the second radiator, the temporarily assembled first and second radiators are put into a brazing furnace in a state where the reservoir tank and the communication pipe are temporarily assembled with the second radiator, and then, the first and second radiators and the reservoir tank are formed integrally with one another while clad material is melted at their bonded portions.

5. The heat exchanger according to claim 1, wherein each of the first and second radiators includes:

a pair of header tanks spaced apart from each other and formed by combining headers and tanks with each other;

a plurality of tubes whose ends are coupled between the header tanks in such a manner as to fluidically communicate with one another to allow cooling water to flow therethrough; and radiation fins mounted between the tubes, wherein one side header of the first radiator and one side header of the second radiator are formed as separate parts, and the other side header of the first radiator and the other side header of the second radiator are formed as separate parts, wherein the header tanks of the first radiator have a cooling water inlet and a cooling water outlet, and wherein one of the header tanks of the second radiator has a cooling water inlet, wherein said tanks are of the integral-type.

6. The heat exchanger according to claim 5, further comprising:

a first support mounted on the first radiator to fix the radiation fins arranged on the outer surface of at least one of one side tube and the other side tube located at the outermost side of the first radiator; and a second support mounted on the second radiator to fix the radiation fins arranged on the outer surface of at least one of one side tube and the other side tube located at the outermost side of the second radiator.

7. The heat exchanger according to claim 5, wherein one side tank of the first radiator and one side tank of the second radiator are formed integrally with each other, and a baffle is formed in the integral-type tank for partitioning the inner space of the integral-type tank, and wherein the other side tank of the first radiator and the other side tank of the second radiator are formed integrally with each other, and another baffle is formed in the integral-type tank for partitioning the inner space of the integral-type tank.

8. The heat exchanger according to claim 5, wherein after the second radiator is temporarily assembled with the header tanks, the tubes, the cooling water inlet and the cooling water outlet, the temporarily assembled second radiator is put into a brazing furnace in a state where the reservoir tank and the communication pipe are temporarily assembled with the second radiator, and then, the second radiator and the reservoir tank are formed integrally with each other while clad material is melted at their bonded portions.

9. The heat exchanger according to claim 2, wherein the second radiator and the reservoir tank are temporarily assembled with each other in such a way that one end of the communication pipe is fluidically communicated with a though-hole formed on the reservoir tank and the other end of the communication pipe is fluidically communicated with a though-hole formed on the tank of the header tank of the second radiator, so that the reservoir tank and the second radiator are bonded with each other by means of brazing.

* * * * *